US006004453A

United States Patent [19]

Benham et al.

[11] Patent Number: 6,004,453

[45] Date of Patent: Dec. 21, 1999

[54] HYDROCRACKING OF HEAVY HYDROCARBON OILS WITH CONVERSION FACILITATED BY RECYCLE OF BOTH HEAVY GAS OIL AND PITCH

[75] Inventors: N. Kelly Benham; Barry B. Pruden, both of Calgary; Michel Roy, Repentigny, all of Canada

[73] Assignee: Petro-Canada, Calgary, Canada

[21] Appl. No.: 09/035,915

[22] Filed: Mar. 6, 1998

Related U.S. Application Data

[63] Continuation-in-part of application No. 08/576,334, Dec. 21, 1995, Pat. No. 5,755,955.

[51] Int. Cl.[6] ..... C10G 47/07

[52] U.S. Cl. ..... 208/108; 208/107; 208/48 R; 208/48 AA; 208/100

[58] Field of Search ..... 208/112, 107, 208/48 R, 48 AA, 108, 100

[56] References Cited

U.S. PATENT DOCUMENTS

| | | | |
|---|---|---|---|
| 3,412,010 | 11/1968 | Alpert et al. . | |
| 3,681,231 | 8/1972 | Alpert et al. . | |
| 3,775,286 | 11/1973 | Mukherjee et al. | 208/9 |
| 4,214,977 | 7/1980 | Ranganathan et al. | 208/108 |
| 4,299,685 | 11/1981 | Khulbe et al. | 208/488 |
| 4,853,337 | 8/1989 | Dickakian . | |
| 4,897,176 | 1/1990 | Dickakian . | |
| 4,969,988 | 11/1990 | Jain et al. | 208/108 |
| 5,120,427 | 6/1992 | Stine et al. . | |
| 5,190,633 | 3/1993 | Fetzer et al. . | |
| 5,328,591 | 7/1994 | Raterman . | |
| 5,374,348 | 12/1994 | Sears et al. . | |
| 5,755,955 | 5/1998 | Benham et al. | 208/107 |

*Primary Examiner*—Helane Myers

[57] ABSTRACT

A process for hydrocracking a heavy hydrocarbon oil feedstock, a substantial portion of which boils above 524° C. is described which includes the steps of: (a) passing a slurry feed of a mixture of heavy hydrocarbon oil feedstock and from about 0.01–4.0% by weight (based on fresh feedstock) of coke-inhibiting additive particles upwardly through a confined vertical hydrocracking zone, the hydrocracking zone being maintained at a temperature between about 350° and 600° C. a pressure of at least 3.5 MPa and a space velocity of up to 4 volumes of hydrocarbon oil per hour per volume of hydrocracking zone capacity, (b) removing from the top of the hydrocracking zone a mixed effluent containing a gaseous phase comprising hydrogen and vaporous hydrocarbons and a liquid phase comprising heavy hydrocarbons, (c) passing the mixed effluent into a hot separator vessel, (d) withdrawing from the top of the separator a gaseous stream comprising hydrogen and vaporous hydrocarbons, (e) withdrawing from the bottom of the separator a liquid stream comprising heavy hydrocarbons and particles of the coke-inhibiting additive, and (f) fractionating the separated liquid stream to obtain a heavy hydrocarbon stream which boils above 450° C. said heavy hydrocarbon stream containing said additive particles, and a light oil product. According to the novel feature, at least part of the fractionated heavy hydrocarbon stream boiling above 450° C. is recycled to form part of the heavy hydrocarbon oil feedstock at a lower polarity aromatic oil is added to the heavy hydrocarbon oil feedstock such that a high ratio of lower polarity aromatics to asphaltenes is maintained during hydroprocessing. This provides excellent yields without coke formation.

9 Claims, 7 Drawing Sheets

HYDROCRACKING OF HEAVY HYDROCARBON OILS WITH CONVERSION FACILITATED BY RECYCLE OF BOTH HEAVY GAS OIL AND PITCH

This is a continuation-in-part of U.S. application Ser. No. 08/576,334, now U.S. Pat. No. 5,755,955 filed Dec. 21, 1995.

BACKGROUND OF THE INVENTION

This invention relates to the treatment of hydrocarbon oils and, more particularly, to the hydroconversion of heavy hydrocarbon oils in the presence of particulate additives for inhibiting coke formation.

Hydroconversion processes for the conversion of heavy hydrocarbon oils to light and intermediate naphthas of good quality for reforming feedstocks, fuel oil and gas oil are well known. These heavy hydrocarbon oils can be such materials as petroleum crude oil, atmospheric tar bottoms products, vacuum tar bottoms products, heavy cycle oils, shale oils, coal derived liquids, crude oil residuum, topped crude oils and the heavy bituminous oils extracted from oil sands. Of particular interest are the oils extracted from oil sands and which contain wide boiling range materials from naphthas through kerosene, gas oil, pitch, etc., and which contain a large portion of material boiling above 524° C. equivalent atmospheric boiling point.

As the reserves of conventional crude oils decline, these heavy oils must be upgraded to meet the demands. In this upgrading, the heavier materials is converted to lighter fractions and most of the sulphur, nitrogen and metals must be removed.

This can be done either by a coking process, such as delayed of fluidized coking, or by a hydrogen addition process such as thermal or catalytic hydrocracking. The distillate yield from the coking process is typically about 80 wt. % and this process also yields substantial amounts of coke as by-product.

Work has also been done on an alternate processing route involving hydrogen addition at high pressures and temperatures and this has been found to be quite promising. In this process, hydrogen and heavy oil are pumped upwardly through an empty tubular reactor in the absence of any catalyst. It has been found that the high molecular weight compounds hydrogenate and/or hydrocrack into lower boiling ranges. Simultaneous desulphurization, demetallization and denitrogenation reactions take place.

Work has been done to develop additives which can suppress coking reaction or can remove the coke from the reactor. It has been shown in Ternan et al., Canadian Patent No. 1,073,389, issued Mar. 10, 1980 and Ranganathan et al., U.S. Pat. No. 4,214,977, issued Jul. 29, 1980, that the addition of coal or coal-based additive results in the reduction of coke deposition during hydrocracking. The coal additives act as sites for the deposition of coke precursors and thus provide a mechanism for their removal from the system.

Ternan et al., Canadian Patent No. 1,077,917 describes a process for the hydroconversion of a heavy hydrocarbonaceous oil in the presence of a catalyst prepared in situ from trace amounts of metals added to the oil as oil soluble metal compounds.

In U.S. Pat. No. 3,775,286, a process is described for hydrogenating coal in which the coal was either impregnated with hydrated iron oxide or dry hydrated iron oxide powder was physically mixed with powdered coal. Canadian Patent No. 1,202,588 describes a process for hydrocracking heavy oils in the presence of an additive in the form of a dry mixture of coal and an iron salt, such as iron sulphate.

Fly ash is described as a useful additive for suppressing coke formation in U.S. Pat. No. 4,299,685 and pyrite as a particulate additive is described in Canadian Patent 1,152,925.

Development of such additives has allowed the reduction of reactor operating pressure without coking reaction. However the injection of large amounts of fine additive is costly, and the application is limited by the incipient coking temperature, at which point mesophase (a pre-coke material) is formed in increasing amounts.

Further, it is shown in Jain et al., U.S. Pat. No. 4,969,988 that conversion can be further increased through reduction of gas hold-up by injecting an anti-foaming agent, preferably into the top section of the reactor.

Sears et al., U.S. Pat. No. 5,374,348 teaches recycle of heavy vacuum fractionator bottoms to the reactor to reduce overall additive consumption by 40% more.

It is the object of the present invention to provide a process for hydrocracking heavy hydrocarbon oils using additive particles in the feedstock to suppress coke formation in which improved yields can be achieved by increased reaction temperatures facilitated by increased nitrogen levels in the reaction zone.

SUMMARY OF THE INVENTION

According to the present invention, it has been discovered that further improvements in the hydroprocessing of heavy hydrocarbon oils containing additive particles to suppress coke formation are achieved by both (a) recycling a downstream fractionated heavy product to the hydroprocessing feedstock and (b) simultaneously recycling a downstream fractionated aromatic heavy gas oil to the hydroprocessing feedstock.

Thus, the present invention in one aspect relates to a process for hydrocracking a heavy hydrocarbon oil feedstock, a substantial portion of which boils above 524° C. which comprises: (a) passing a slurry feed of a mixture of heavy hydrocarbon oil feedstock and from about 0.01–4.0% by weight (based on fresh feedstock) of coke-inhibiting additive particles upwardly through a confined vertical hydrocracking zone in the presence of hydrogen and in the absence of an active hydrogenation catalyst, said hydrocracking zone being maintained at a temperature above about 450° C., a pressure of at least 3.5 MPa and a space velocity of up to 4 volumes of hydrocarbon oil per hour per volume of hydrocracking zone capacity, (b) removing from the top of said hydrocracking zone a mixed effluent containing a gaseous phase comprising hydrogen and vaporous hydrocarbons and a liquid phase comprising heavy hydrocarbons, (c) passing said mixed effluent into a hot separator vessel, (d) withdrawing from the top of the separator a gaseous stream comprising hydrogen and vaporous hydrocarbons, (e) withdrawing from the bottom of the separator a liquid stream comprising liquid hydrocarbons and particles of the coke-inhibiting additive, (f) fractionating the separated liquid stream to obtain a pitch bottom stream which boils above 450° C. said pitch stream containing said additive particles, and an aromatic heavy gas oil fraction. According to the novel feature, (1) at least part of said pitch stream boiling above 450° C. and containing additive particles is recycled to form part of the heavy hydrocarbon oil feedstock and (2) at least part of the aromatic heavy gas oil fraction is simultaneously recycled to form part of the feedstock to the hydrocracking zone.

The aromatic heavy gas oil according to this invention is a process derived oil obtained by fractionating a liquid hydrocarbon stream obtained from the hydrocracking. This aromatic heavy gas oil typically boils in the range of 360 to 524° C. and preferably above 400° C.

The process of this invention is capable of processing a wide range of heavy hydrocarbon feedstocks. Thus, it can process aromatic feedstocks, as well as feedstocks which have traditionally been very difficult to hydroprocess, e.g. visbroken vacuum residue, deasphalted bottom materials, off-specification asphalt, grunge from the bottom of oil storage tanks, etc. These difficult-to-process feedstocks are characterized by low reactivity in visbreaking, high coking tendency, poor conversion in hydrocracking and difficulties in distillation. They have, in general, a low ratio of polar aromatics to asphaltenes and poor reactivity in hydrocracking relative to aromatic feedstocks.

Most feedstocks contain asphaltenes to a more or less degree. Asphaltenes are high molecular weight compounds containing heteroatoms which impart polarity. It has been shown by the model of Pfeiffer and Sal, Phys. Chem. 44 139 (1940), that asphaltenes are surrounded by a layer of resins, or polar aromatics which stabilize them in colloidal suspension. In the absence of polar aromatics, or if polar aromatics are diluted by paraffinic molecules, these asphaltenes can self-associate, or flocculate to form larger molecules which can precipitate out of solution. This is the first step in coking.

In a normal hydrocracking process, there is a tendency for asphaltenes to be converted to lighter materials, such as paraffins and aromatics. Polar aromatics are also converted to lighter materials, but at a higher rate than the asphaltenes. The result is that the ratio of polar aromatics to asphaltenes decreases, and the ratio of paraffins to aromatics increases as the reaction progresses. This eventually leads to asphaltene flocculation, mesophase formation and coking. This coking can be minimized by the use of an additive, and coking can also be controlled at the incipient coking temperature, which is the temperature at which coking just begins for a fixed additive concentration. This temperature is quite low for poor feeds, resulting in poor conversion.

In the process of this invention, it is now possible to very successfully process feedstocks that are traditionally very difficult to process. This is achieved by firstly recycling the downstream pitch stream boiling above 450° C. with additive particles and secondly adding a lower polarity aromatic oil to the feedstock, this aromatic oil being a downstream fractionated aromatic heavy gas oil.

As stated above, the asphaltenes in the feedstock, which are a problem in terms of coke formation, are surrounded by a shell of highly polar aromatics. Increasing conversion increases the polarity of the aromatic shell around the asphaltene. However, in accordance with this invention, by introducing lower polarity aromatics into the reaction system, these lower polarity aromatics are able to surround and mix with and dilute the highly polar aromatics. This also tends to reduce the polar gradient so as to allow hydrogen to pass in through the shell and to allow olefinic fragments to diffuse out and prevent recombination. This permits time for the asphaltene to break down in the process. The term "aromatics of lower polarity" as used herein means aromatic oils of low polarity relative to the polarity of components such as asphaltenes in the heavy hydrocarbon feedstock.

Thus, by controlling the very polar aromatics in the reaction system according to this invention, a balance is maintained such that the asphaltenes "see" aromatics including those of lower polarity everywhere. Paraffins that are formed are diluted and can diffuse quickly in this continuum. Also as explained above, any mass transfer limitations that were previously caused by the very polar aromatic shell are minimized and the dispersion of olefins in the aromatics of lower polarity lessens recombination reactions and decreases the probability of recombination with the asphaltenes. Non-aromatic fragments formed from asphaltenes diffuse away from the asphaltene core and prevent molecular weight growth through recombination.

By controlling polar aromatics through further aromatics addition, pitch reactivity is maintained and coking tendency is reduced. Pitch can be recycled under these conditions, which results in a conversion increase. This reduces pitch molecular weight which further stabilizes the operation at high overall conversion. It was expected that this extensive recycling would have a serious effect on the productivity of the reactor, but it was discovered that this effect on productivity is more than offset by the higher reactor temperatures that became possible. It appears that there are no compounds that intrinsically form coke, only limitations imposed by the colloidal system, and by mass transfer in the system. It further appears that there is no intrinsic incipient coking temperature for each feedstock, only the necessity to suspend the additive, and suspend and carry asphaltenes until they are converted or exit the reactor.

There is an additional benefit of high conversion that is not immediately apparent. The liquid traffic in the reactor, which is made up of pitch and low polar aromatic oil, is much reduced. This can be controlled by recycle, and in such a way that the reactor additive is much increased over a once through operation. This allows the process to be much more stable as incremental additive surface area is available to aid hydrogen transfer to the olefins and aromatics generated.

The process of this invention can be operated at quite moderate pressure, preferably in the range of 3.5 to 24 Mpa without coke formation in the hydrocracking zone. The LHSV is typically below 4 $h^{-1}$ on a fresh feed basis, with a range of 0.1 to 3 $h^{-1}$ being preferred and a range of 0.3 to 1 $h^{-1}$ being particularly preferred.

An important advantage of this invention is that the process can be operated at a higher temperature and lower hydrogen partial pressure than usual processes for cracking heavy oils. It has been previously known to add aromatic oils to hydrogenation processes, particularly with high asphaltene feedstocks. These have been used, for instance, with active hydrogenation catalysts, such as silica/alumina catalyst containing active metals or metal oxides, e.g. nickel molybdate on silica/alumina. Such addition of aromatic oils was known to have benefits in decreasing catalyst replacement rate, provided that a temperature increase could be accommodated to offset the increased throughput and thus maintain conversion. Such catalysts are utilized near the exponential coking region, so that a modest rise of only in the order of about 10° C. can be tolerated. Thus, such recycle was not found to necessarily have the proper character to significantly improve system conversion or throughput of fresh feed. From the teachings of the literature, the conventional wisdom has been that the addition of a heavy gas oil recycle stream to a hydrocracking process of the present type would only add to the volume of throughput in the reactor and would be expected to have no particular benefits.

Decant oils from fluid catalytic cracking processes have been tried as diluents for hydrogenation processes utilizing high asphaltene crudes. This permitted a marginal increase in reactor temperature and prevented coke formation within the hydrocracking zone but with this decant oil as diluent, coking problems occurred downstream in the vacuum tower. It was found that the hydrocracking reactor temperatures were limited to a maximum of about 450° C. because of the problem of the downstream coke formation. When an active hydrogenation catalyst of the type discussed above is used, the reaction temperatures are normally limited to a maximum of about 450° C.

It is known that pitch conversion in a hydrocracking zone is dependent on reaction temperature and as a general rule, there is a one percent conversion gain for each 1° F. temperature increase of the reaction zone. Published results for a hydrocracking process on high asphaltene crudes using an active hydrogenation catalyst have shown 524° C.+conversions in the order of about 55 to 70%. These were conducted at hydroconversion conditions including a maximum temperature of about 450° C. with this temperature being limited because higher temperatures caused coking of the active hydrogenation catalyst.

However, when a process derived aromatic heavy gas oil stream is recycled according to this invention, it has surprisingly been found that the hydrocracking temperatures can be increased to as high as 470° C. and very high conversions of over 90% are achieved without any coke formation throughout the process. It is believed that the very high conversions that are obtained according to this invention are the result of a combination of the high temperatures in the hydrocracking zone that are possible and the resultant very high nitrogen levels found in the heavy gas oil stream. This high nitrogen content is very beneficial to the process within the hydrocracking zone. The nitrogen content of the heavy gas oil stream obtained according to the present invention has been found to be approximately 20% higher than the nitrogen content of the gas oil stream obtained in the hydrocracking of a high asphaltene crude using an active hydroconversion catalyst. A typical gas oil obtained using an active hydroconversion catalyst may contain about 80% of the feed nitrogen concentration, while a recycled gas oil of this invention typically contains about 100 to 110% of the feed nitrogen concentration. It is believed that heavy gas oil acts to stabilize asphaltenes by surrounding them with an aromatic/polar shell. The heavy gas oil is particularly efficient in this, not only because of its high nitrogen content, but because a high portion remains in the liquid phase due to its boiling range and stability to cracking, having been through the reactor at least once previously.

Although the hydrocracking can be carried out in a variety of known reactors of either up or downflow, it is particularly well suited to a tubular reactor through which feed and gas move upwardly. The effluent from the top is preferably separated in a hot separator and the gaseous stream from the hot separator can be fed to a low temperature, high pressure separator where it is separated into a gaseous stream containing hydrogen and less amounts of gaseous hydrocarbons and liquid product stream containing light oil product.

A variety of additive particles can be used in the process of the invention, provided these particles are able to survive the hydrocracking process and remain effective as part of the recycle. As examples of such additive particles, there may be mentioned coal, iron-coal, fly ash, pyrite, other iron compounds, etc. These are used preferably in small particle sizes of less than 45 $\mu$m and it is important for use in this invention that the additive particles not be active hydrogenation catalysts. Another range of possible additives derive from the fine material native to mined bitumen which has been shown to be moderately effective in the coke suppression.

According to a preferred embodiment, the additive particles are mixed with a heavy hydrocarbon oil feed and pumped along with hydrogen through a vertical reactor. The liquid-gas mixture from the top of the hydrocracking zone can be separated in a number of different ways. One possibility is to separate the liquid-gas mixture in a hot separator kept at a temperature in the range of about 200°–470° C. and at the pressure of the hydrocracking reaction. A portion of the heavy hydrocarbon oil product from the hot separator is used to form the recycle stream of the present invention after secondary treatment. Thus, the portion of the heavy hydrocarbon oil product from the hot separator being used for recycle is fractionated in a distillation column with a heavy liquid or pitch stream being obtained which boils above 450° C. This pitch stream preferably boils above 495° C. with a pitch boiling above 524° C. being particularly preferred. This pitch stream is then recycled back to form part of the feed slurry to the hydrocracking zone. An aromatic gas oil fraction boiling above 400° C. is also removed from the distillation column and it is recycled back to form part of the feedstock to the hydrocracking zone for the purpose of controlling the ratio of polar aromatics to asphaltenes.

Preferably the recycled heavy oil stream makes up in the range of about 5 to 15% by weight of the feedstock to the hydrocracking zone, while the aromatic oil, e.g. recycled aromatic gas oil, makes up in the range of 15 to 50% by weight of the feedstock, depending upon the feedstock structures.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber and the scrubbed hydrogen may be recycled as part of the hydrogen feed to the hydrocracking process. The hydrogen gas purity is maintained by adjusting scrubbing conditions and by adding make up hydrogen.

The liquid stream from the low temperature-high pressure separator represents a light hydrocarbon oil product of the present invention and can be sent for secondary treatment.

According to a preferred embodiment, the heavy oil product from the hot separator is fractionated into a top light oil stream and a bottom stream comprising pitch and heavy gas oil. A portion of this mixed bottoms stream is recycled back as part of the feedstock to the hydrocracker while the remainder of the bottoms stream is further separated into a heavy gas oil stream and a pitch product. The heavy gas oil stream is then recycled to the feedstock to the hydrocracker as an aromatic heavy gas oil additive.

The process of the invention can convert heavy gas oil to extinction and can also convert a very high proportion of the heavy hydrocarbon materials of the feedstock to liquid products boiling below 400° C. These features make the process useful as an outlet for surplus refinery aromatic streams. It is also uniquely useful as an outlet for junk feedstocks. Furthermore, the process represents a unique method of control for the hydrocracking of heavy hydrocarbon oils by controlling the quantities and compositions of the pitch stream and the aromatic oil stream fed as part of the feedstock to the hydrocracking process.

BRIEF DESCRIPTION OF THE DRAWINGS

For a better understanding of the invention, reference is made to the accompanying drawings in which.

DESCRIPTION OF THE PREFERRED EMBODIMENTS

Figure 1:
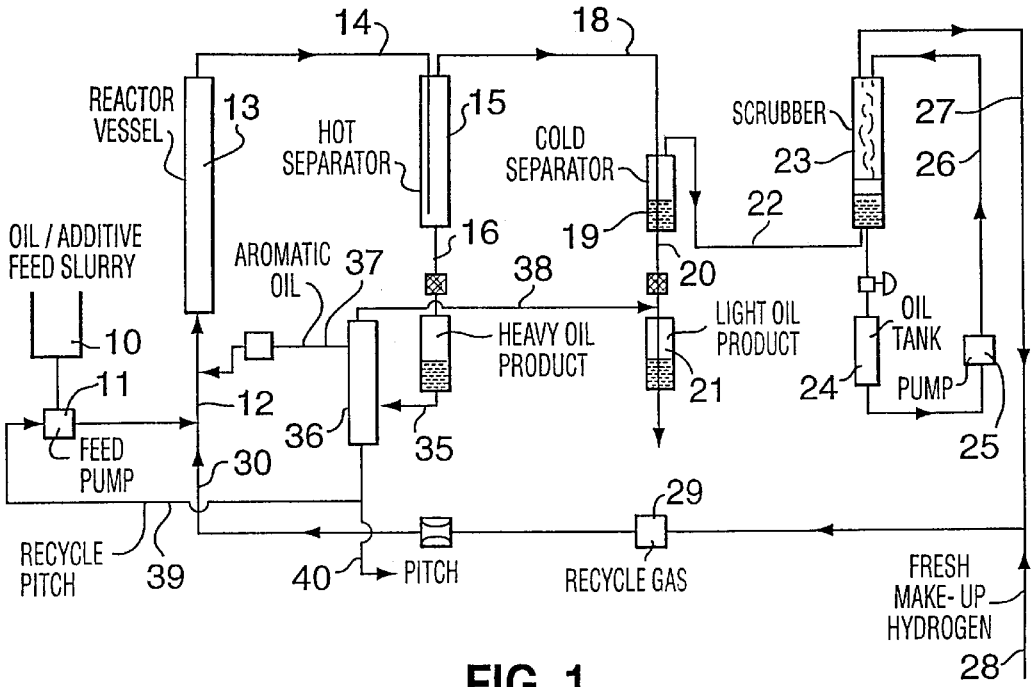
FIG. 1 is a schematic flow sheet showing a typical hydrocracking process to which the present invention may be applied.

In the hydrocracking process as shown in the drawing, the additive particles are mixed together with a heavy hydrocarbon oil feed in a feed tank 10 to form a slurry. This slurry, including heavy oil or pitch recycle 39, is pumped via feed pump 11 through an inlet line 12 into the bottom of an empty reactor 13. Recycled hydrogen and make up hydrogen from line 30 are simultaneously fed into the reactor through line 12. A gas-liquid mixture is withdrawn from the top of the reactor through line 14 and introduced into a hot separator 15. In the hot separator the effluent from tower 13 is separated into a gaseous stream 18 and a liquid stream 16. The liquid stream 16 is in the form of heavy oil which is collected at 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen-rich stream 22 is passed through a packed scrubbing tower 23 where it is scrubbed by means of a scrubbing liquid 24 which is recycled through the tower by means of a pump 25 and recycle loop 26. The scrubbed hydrogen-rich stream emerges from the scrubber via line 27 and is combined with fresh make-up hydrogen added through line 28 and recycled through recycle gas pump 29 and line 30 back to reactor 13.

The heavy oil collected at 17 is used to provide the heavy oil recycle of the invention and before being recycled back into the slurry feed, a portion is drawn off via line 35 and is fed into fractionator 36 with a bottom heavy oil stream boiling above 450° C., preferably above 524° C. being drawn off via line 39. This line connects to feed pump 11 to comprise part of the slurry feed to reactor vessel 13. Part of the heavy oil withdrawn from the bottom of fractionator 36 may also be collected as a pitch product 40.

The fractionator 36 may also serve as a source of the aromatic oil to be included in the feedstock to reactor vessel 13. Thus, an aromatic heavy gas oil fraction 37 is removed from fractionator 36 and is feed into the inlet line 12 to the bottom of reactor 13. This heavy gas oil stream preferably boils above 400° C. A light oil stream 38 is also withdrawn from the top of fractionator 36 and forms part of the light oil product 21 of the invention.

DESCRIPTION OF THE PREFERRED EMBODIMENTS

Certain preferred embodiments of this invention are illustrates by the following non-limiting Examples.

EXAMPLE 1 (COMPARATIVE)

Tests were carried out on a hydrocracker pilot plant of the type shown in FIG. 1 using as feedstock Cold Lake Vacuum Bottoms (CLVB), with 5.6% sulphur, 75% wt of 524° C. material and 5° API. First the CLVB was tested in a once-through mode, and a model developed for this operation and a range of conditions. Next, the pilot plant was operated with pitch recycle, and it was found that the rate constant for the recycled material was:

$$K=0.953-0.0083\ (524^\circ\ C.^{+}\ \text{Conversion})$$

where conversion is in weight percent. Thus the rate constant for fresh feed would be K=0.953, and for pitch product from an 80% of 524° C. conversion operation it would be K=0.953−0.0083 (80)=0.289. This is a significant drop in reactivity for the following typical pilot plant conditions:

Temperature 447° C. Feed 80% fresh/20% recycle

Pressure 13.8 MPa Recycle cut point 480° C.

Gas Rate 28 L/min Fresh feed LHSV 0.48

Gas Purity 85% $H_2$ Additive*' 1.2% on total feed

Reactor 2.54 cm ID by 222 cm high

*The additive used was ferrous sulfate having particle sizes less than 45 $\mu$m as described in U.S. Pat. No. 4,963,247, incorporated herein by reference.

This showed that recycled pitch was less reactive than fresh feed, and that its reactivity was dependent on the conversion (reaction severity) to which it was subjected. This data discouraged recycle of pitch for conversion reasons, and seemed to show that there was a portion of the feed which was inherently not convertible, or convertible only with difficulty.

These tests did, however, show that recycled iron sulphide additive retained its activity, which is a strong incentive for recycle of pitch (recycle reduced fresh additive requirement by as much as 40% in the study).

EXAMPLE 2 (COMPARATIVE)

Visbroken vacuum residue from a commercial visbreaker in the Montreal refinery of Petro-Canada (a Shell soaker type) was tested in the same pilot plant as in Example 1. Conditions for a sample test were as follows:

Temperature 449° C.

Pressure 13.8 Mpa

Gas Rate 28 L/min

Gas Purity 85% $H_2$

Fresh Feed LHSV 0.5, feed origin—Venezuelan Blend 24

Additive* 3% on total feed

*The additive used was ferrous sulfate having particle sizes less than 45 $\mu$m as described in U.S. Pat. No. 4,963,247, incorporated herein by reference.

Figure 2:
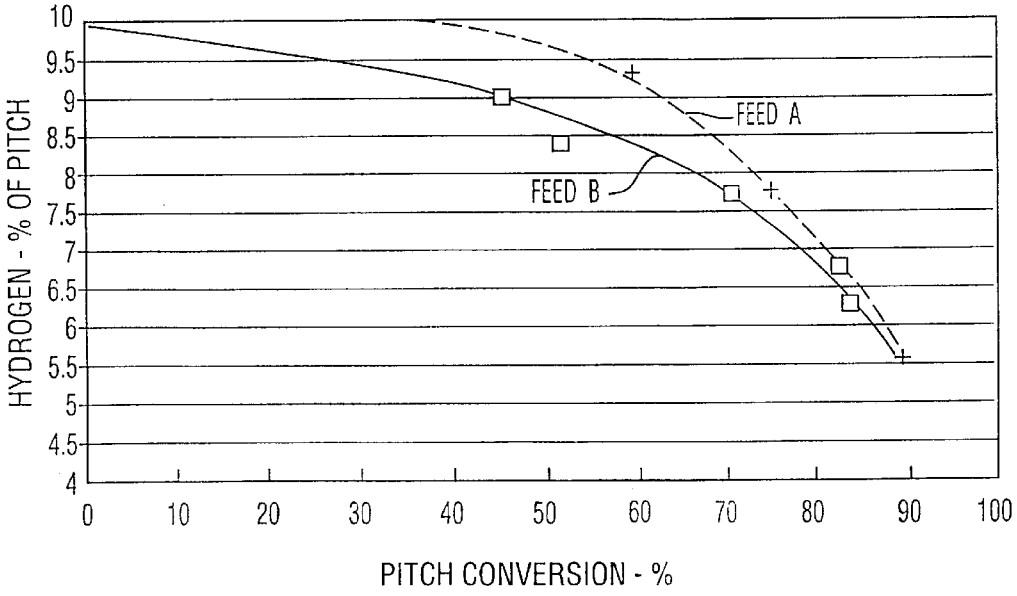
FIG. 2 is a plot of hydrogen in pitch vs. conversion.
Figure 3:
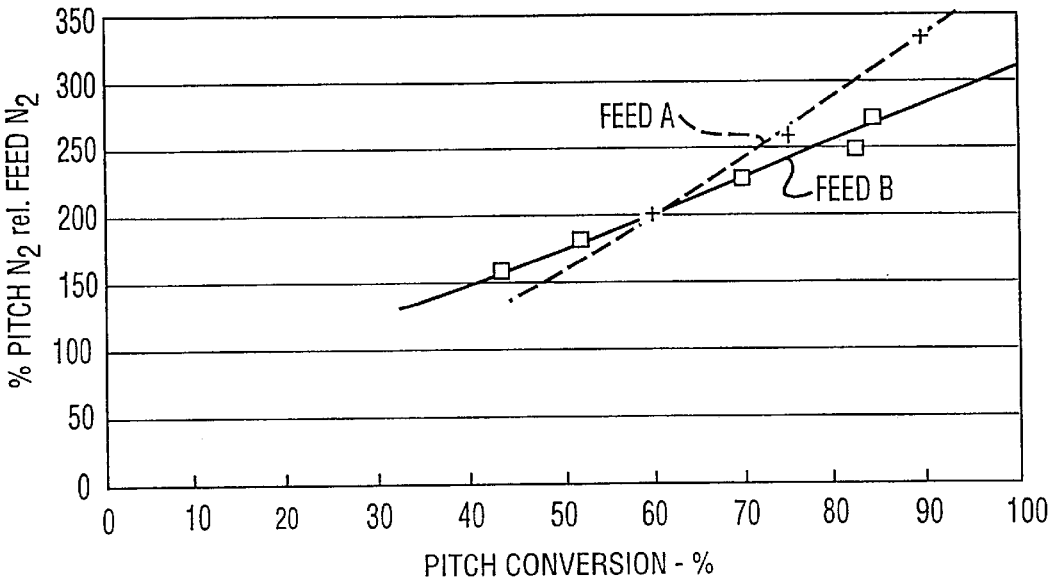
FIG. 3 is a plot of nitrogen in pitch vs. conversion.
Figure 4:
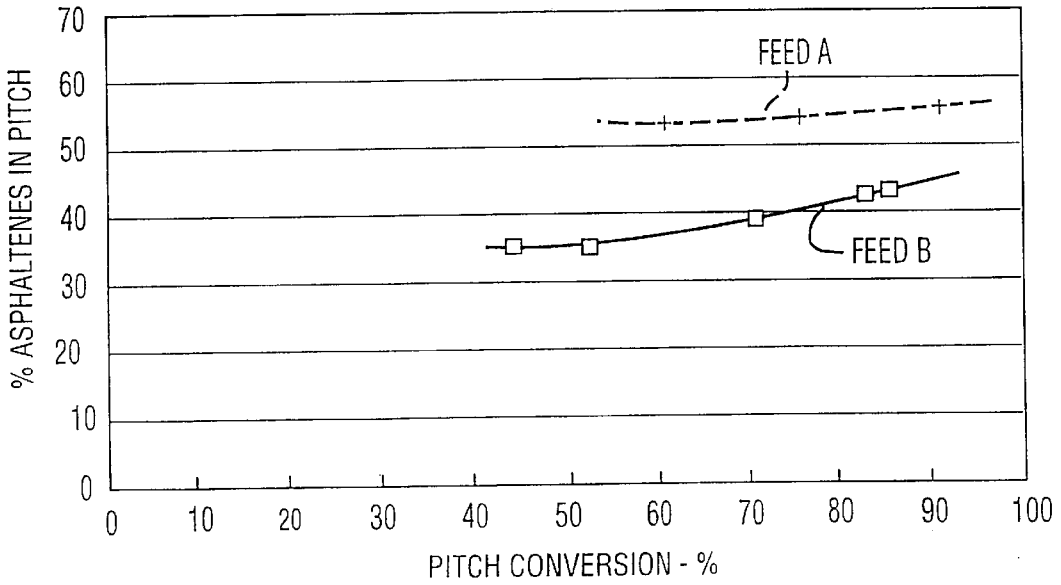
FIG. 4 is a plot of asphaltene in pitch vs. conversion.
Figure 5:
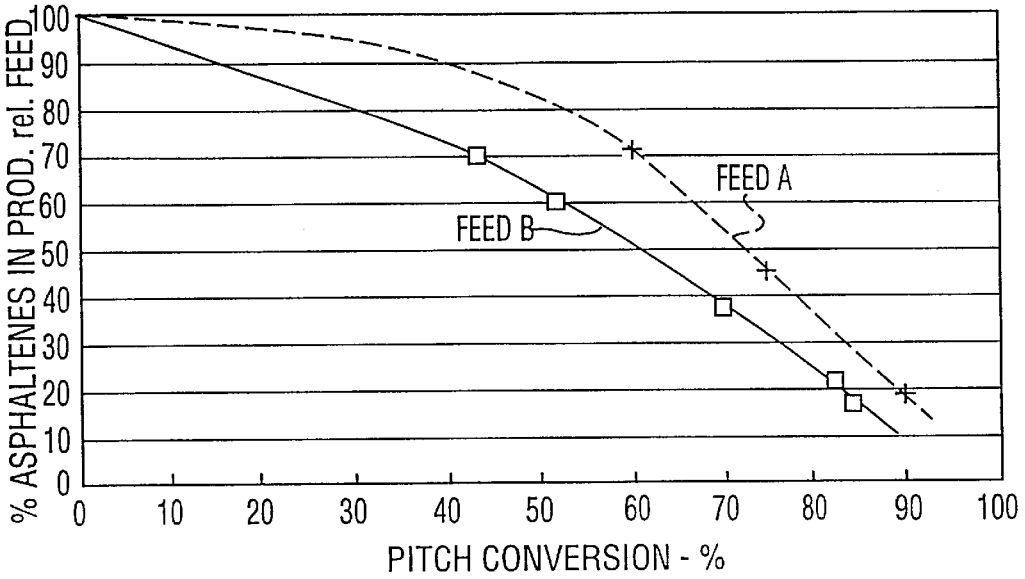
FIG. 5 is a plot of asphaltene in reactor products vs. conversion.

Pitch conversion was found to be 83%, and this was comparable to 85% conversion obtained with Blend 24 vacuum bottoms feed under similar conditions. This run showed that a visbroken material could be run at comparable conversion (to virgin material of same boiling range). However it also showed that pitch quality deteriorates with respect to hydrogen and nitrogen content (FIGS. 2 and 3), and that asphaltene content increases in pitch as conversion increases (FIG. 4). In the above figures, the curves for VVR PP are for runs with visbroken vacuum residuum derived from Venezuelan Blend 24 and for Cold Lake residuum, designated CLPP, run in the same pilot plant under similar conditions. The curves for CLPP show that there are similar changes in pitch properties when a virgin material is hydrocracked. For both feedstocks there was a uniform destruction of feed asphaltenes (FIG. 5) and a deterioration in pitch properties already mentioned. Decreases in pitch hydrogen content indicate condensed aromatic ring structures, and increased nitrogen indicates that these ring structures are more polar. These changes are very significant and are probably irreversible for the above systems.

EXAMPLE 3

Examples 1 and 2 were both run without feeding extra aromatic oil to the hydrocracker. This example shows the effects of adding extra aromatic oil in the form of vacuum gas oil (VGO).

Feedstock in this case was Cold Lake residuum of 5.5° API, sulphur 5.0% , nitrogen 0.6% and 15% boiling below 524° C. This material was obtained from a refinery run and contained up to 20% of Western Canadian blend. The gas oil obtained from a once-through run with this feedstock at 86% conversion, was at 14.9% API, 2.2% sulphur, 0.53% nitrogen and had 10%, 50% and 90% points of 330, 417, and 497° C. respectively. Tests were made which simulate 30, 50, 75 and 100% recycle of the gas oil produced on a once-through basis corresponding to 8.5, 14.1, 19.5 and 24.5 wt. % FF respectively in FIGS. 6–8. All runs were at 3.6% iron-sulfate additive as described in Example 2 on the VTB portion of the feed.

Figure 6:
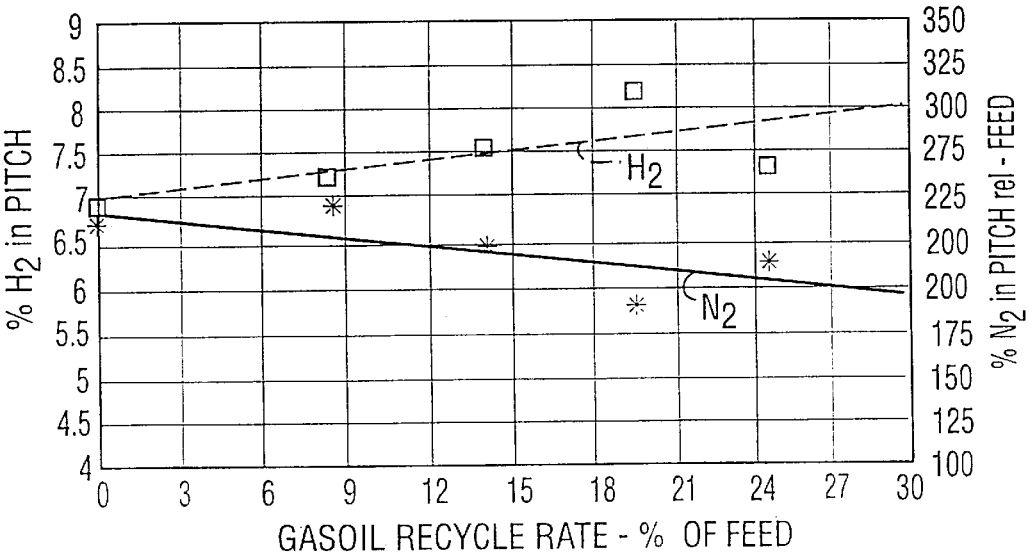
FIG. 6 is a plot of pitch quality vs. VGO recycle rate.

From FIG. 6 it can be seen that, at constant conversion, pitch quality increased with increasing gas oil recycle. Hydrogen content increased by a full 1% to 8% when gas oil was recycled "to extinction". Furthermore, nitrogen content decreased from 240 to 200% in the pitch relative to the fresh feed.

Figure 7:
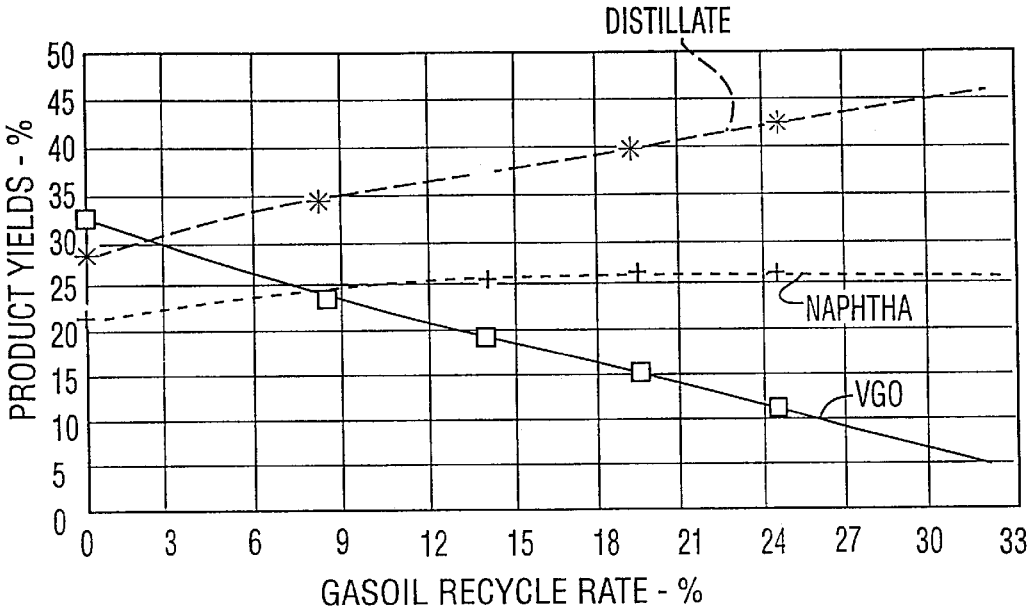
FIG. 7 is a plot of yield shift with VGO recycle.
Figure 8:
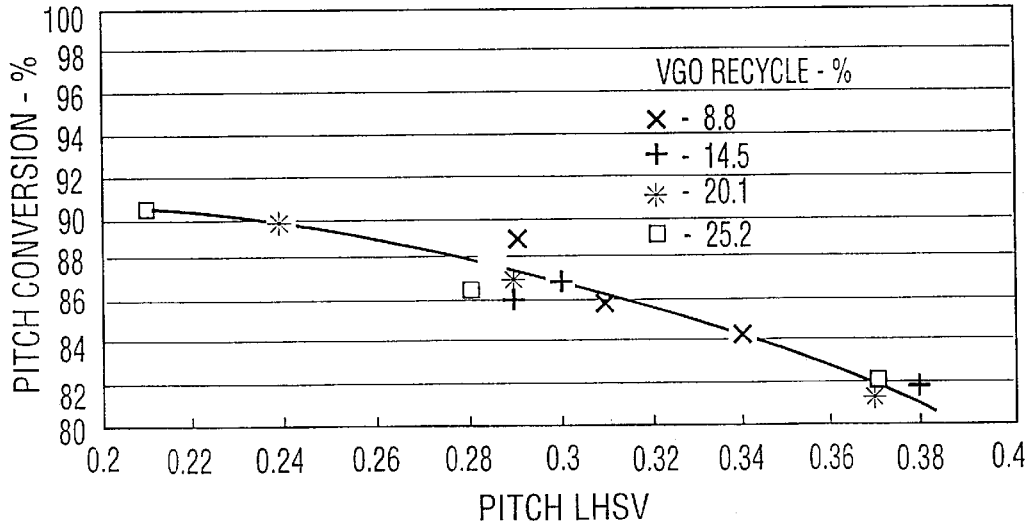
FIG. 8 is a plot of pitch conversion vs. pitch LHSV.

FIG. 7 shows that the gas oil has been converted to lighter products, an additional plus feature for this operation as gas oil can be converted to near extinction. All tests were done with 3.6% additive on fresh feed, which probably masked any effect of VGO recycle on coke yield. This will be discussed further in Example 4. FIG. 8 shows that there was little capacity lost with added VGO recycle. This is a surprising result as there is some VGO accumulation in the reactor, which would be increased under VGO recycle conditions and which would tend to decrease conversion. Pilot plant testing confirmed that VGO conversion is significantly accelerated with increasing temperature.

The above results show that:

1. An improvement in pitch quality is obtained at constant conversion when vacuum gas oil is recycled to the reactor.
2. The VGO is cracked significantly to lighter products when recycled.

EXAMPLE 4

This example gives data from commercial operation of a nominal 5000 BPD hydrocracking unit. The reactor in this case was 6.5 ft in diameter by 70 ft high. Conditions for a run with aromatics addition and pitch recycle were as follows:

Liquid Charge:
- Fresh feed* 3218 BPD, 8.5° API
- Aromatics addition 823 BPD
- Recycle of Pitch 652 BPD
- Total Feed 4693 BPD
- Unit Temperature 464° C.
- Unit Pressure 2024 psi
- Recycle Gas Purity 75%
- 975° F. Conversion 92% wt
- $H_2$ Uptake 907 SCFB
- Additive Rate—wt. % on feed
- 2.3 fresh as $FeSO_4 \cdot H_2O$
- 2.6 recycled as $FeSO_4 \cdot H_2O$
- Additive in Reactor 9.5 wt. %
- TIOR in Reactor 1.86 wt. % as FeS

*Fresh feed was visbreaker vacuum tower bottoms from Flotta crude.

Figure 9:
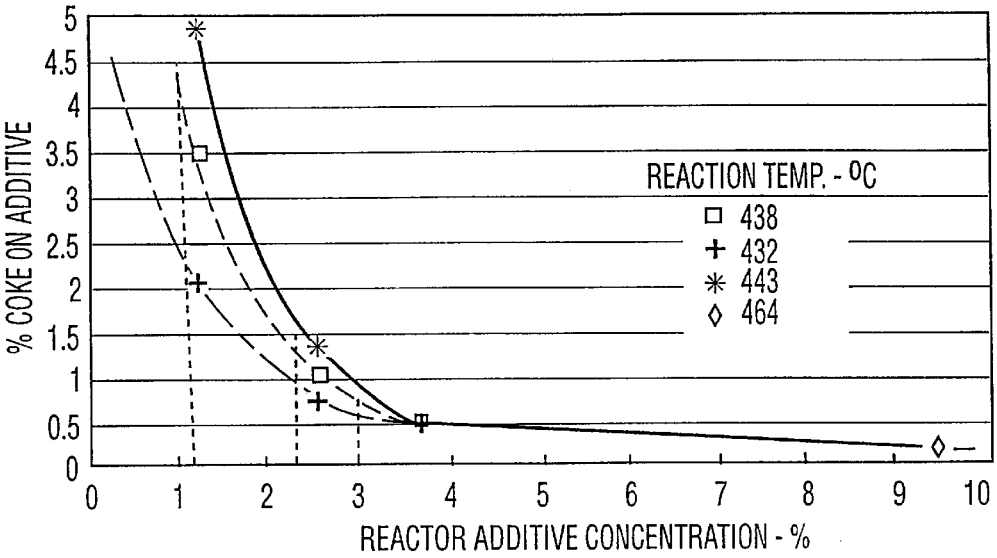
FIG. 9 is a plot of TIOR/additive vs. reactor additive concentration.

Product slate was as follows:
- Fuel Gas 14.2% vol on fresh feed
- 1 BP-400° F. 23.9% vol on fresh feed
- 400–650° F. 37.9% vol on fresh feed
- 650–975° F. 36.9% vol on fresh feed
- 975° $F.^+$ 5.2% vol on fresh feed The above are typical conditions for the combination of pitch recycle and aromatics addition to control polar aromatics in the system for increased efficiency. Without pitch recycle and aromatics addition the expected conversion at this fresh feed charge rate would be 65 to 70%, limited by the incipient coking temperature for this feedstock at about 440° C. There is obvious improvement over a once-through operation, and over a pitch recycle operation without addition of supplementary polar aromatics. This improvement is not only in conversion, but in additive utilization as shown in FIG. 9, a plot of coke/additive ratio in the reactor versus additive concentration in the reactor. Historical "once-through" numbers for reactor additives are in the 1–2% range. Now with pitch recycle and aromatic addition these have increased to 5–9 wt. % range due to increased conversion, concurrent product vaporization, and to additive returned with the pitch.

Figure 10:
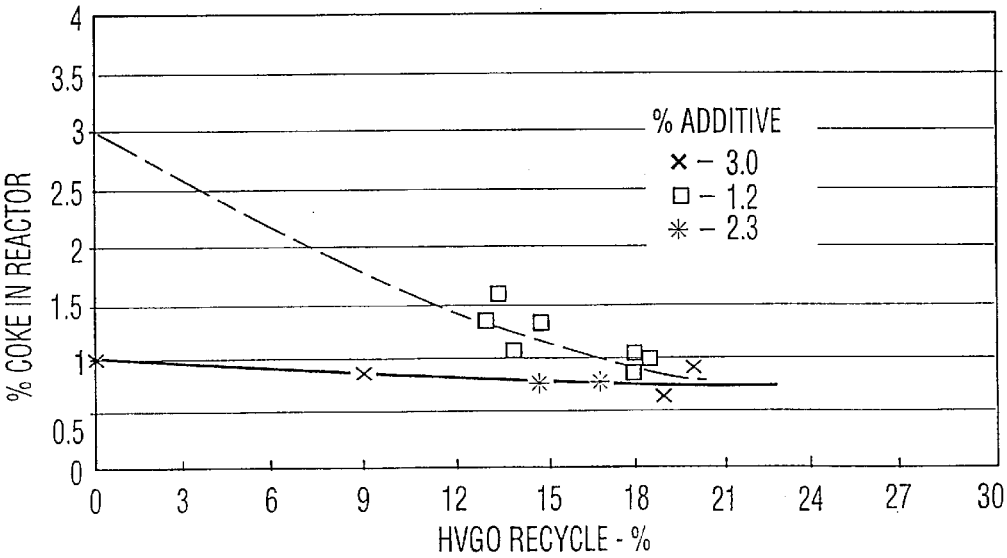
FIG. 10 is a plot of coke yield vs. HVGO recycle.

The increased reactor additive concentration results in lower coke on additive (TIOR/additive in figure) and to conditions for improved conversion, including increased hydrogen addition to pitch which reduces the slide in pitch quality, rendering all pitch capable of conversion. TIOR yield can also be reduced by recycling VGO produced in the unit itself, as shown in FIG. 10 which gives the effect of VGO recycle (as a % of fresh feed) on TIOR yield. The effect is smaller when additive is plentiful, becomes more significant at low feed additive levels, and very dramatic at 1.2% additive on fresh feed.

EXAMPLE 5

This example gives aromatics analyses for selected streams in support of the understanding that polar aromatics control is the key to high conversion and reduced additive consumption.

Figure 11:
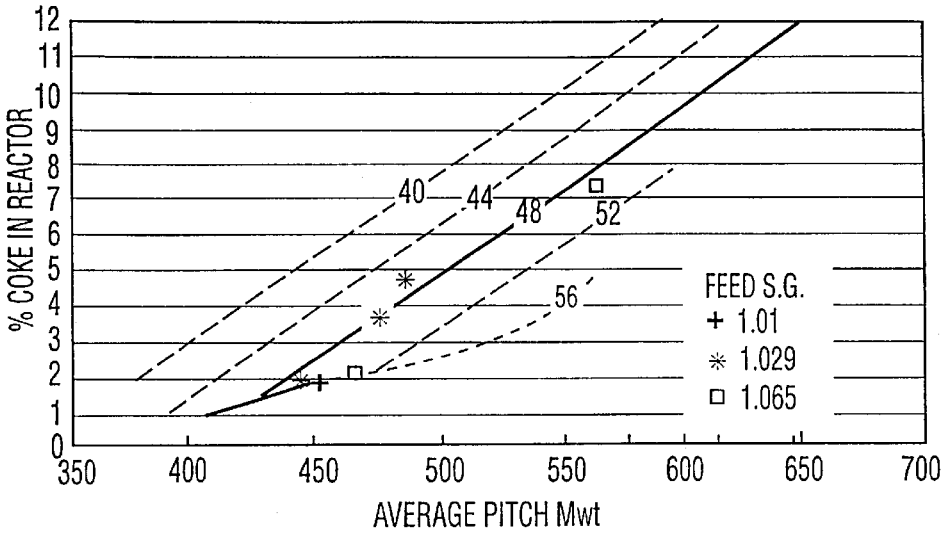
FIG. 11 is a plot of additive coke vs. pitch molecular weight.

FIG. 11 gives average pitch molecular weight versus TIOR in the reactor. The increased average aromatic ring content of the reactor contents allows for operating an elevated TIOR in the reactor. In all the commercial examples in FIG. 11, the mesophase coke levels were much less than 5 microns. The increase stability afforded by the aromatic oil allows for higher reactor operating temperatures which allows for maintaining the average molecular weight of the pitch low enough for coking control even with extremely difficult to convert feedstock.

Table 1 gives hydrocarbon type analyses for aromatic oil (in this case slurry oil or decant oil from a Fluid Catalytic Cracker), and for other feeds and products mentioned in the above Examples. The process generated VGO and decant oil are clearly similar. These samples were taken during a run in which the commercial plant of Example 4 was operating with a visbreaker vacuum tower bottoms feed, with pitch recycle and slurry oil addition similar to Example 4.

Table 1 shows that the ratio of the aromatic and polar aromatics relative to the $nC_7$ insolvable asphaltenes is reduced in both the reactor content and the unconverted pitch relative to the feed. The ratio of the aromatics+polar aromatics to asphaltene in the VVR feed is about 3.86. This ratio drops as the feed is converted with the ratio in the unconverted pitch dropping to 2.07.

For VGO and aromatic oil, the di, tri and tetra-aromatics are predominant, and the streams seem to be interchangeable. An aromatics breakdown for different feedstocks and products is shown in Table 2.

Table 3 shows an elemental analysis of the reactor feed, reactor sample and the unconverted pitch. The visbreaker vacuum tower bottoms (polar phase) is very low in hydrogen content at about 8.2 wt. % and has a very high nitrogen content of 1.1 wt. %. The hydrogen content of the saturate phase is significantly higher at 13.8 wt. %. The $nC_7$ solvent portion of the VVR feed has a hydrogen content of about 10.2 wt. % and a nitrogen content of about 0.43 wt. %.

The reactor contents and the unconverted pitch are found to have similar composition. The nitrogen content of the polar aromatic phase is shown to have been elevated in both the reactor contents and the unconverted pitch relative to the fresh feed. The nitrogen content of the aromatic fraction of the reactor contents and the unconverted pitch is found to be about the same as the fresh feed. The combination of the data in Table 1 and Table 3 shows the nitrogen content of the polar aromatics is concentrating at the same time that the relative amount of polar aromatics to asphaltenes is decreasing.

Table 4 shows the aromatic carbon distribution in the polar aromatic, aromatic and saturate fractions of the feed, reactor and unconverted pitch. The aromaticity of the aromatic and polar aromatic phases have increased significantly relative to the feed. However, the quaternary carbons as a ratio to the total aromatic carbons has been reduced. The quaternary carbons in the VVR fresh feed made up 49 percent of the aromatic carbons in the aromatic and polar aromatic phases. This was reduced to 43 percent of the aromatic carbons in the unconverted pitch, aromatic and polar aromatic phases.

Figure 12:
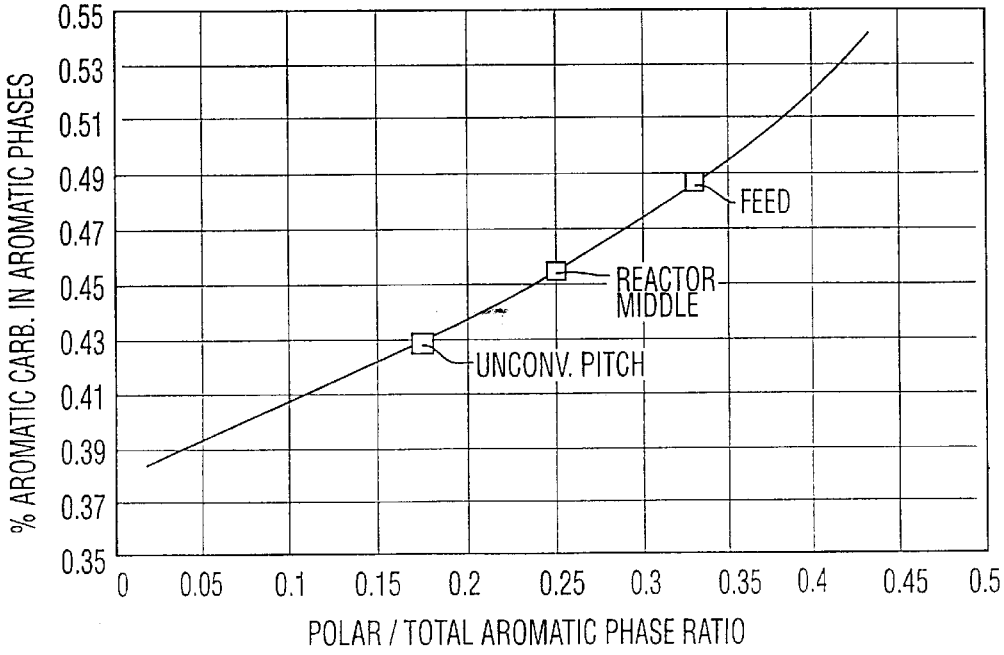
FIG. 12 is a plot of quaternary carbon vs. polar aromatic phase/total aromatic phase.

FIG. 12 is a plot showing the relationship of the quantity of quaternary carbon present in the aromatic and polar aromatic phases with the ratio of the polar aromatics phase to the combined polar aromatic and aromatic phases.

EXAMPLE 6

Tests were conducted on a hydrocracker pilot plant as described in Example 1. The feedstocks were distilled from the same crude oil and comprised (a) 79.6% of 975° F.+material and (b) 69.4% of 975° F.+material. The different feedstocks were hydrocracked at a constant space velocity and varying temperatures and pitch conversions were determined.

Figure 13:
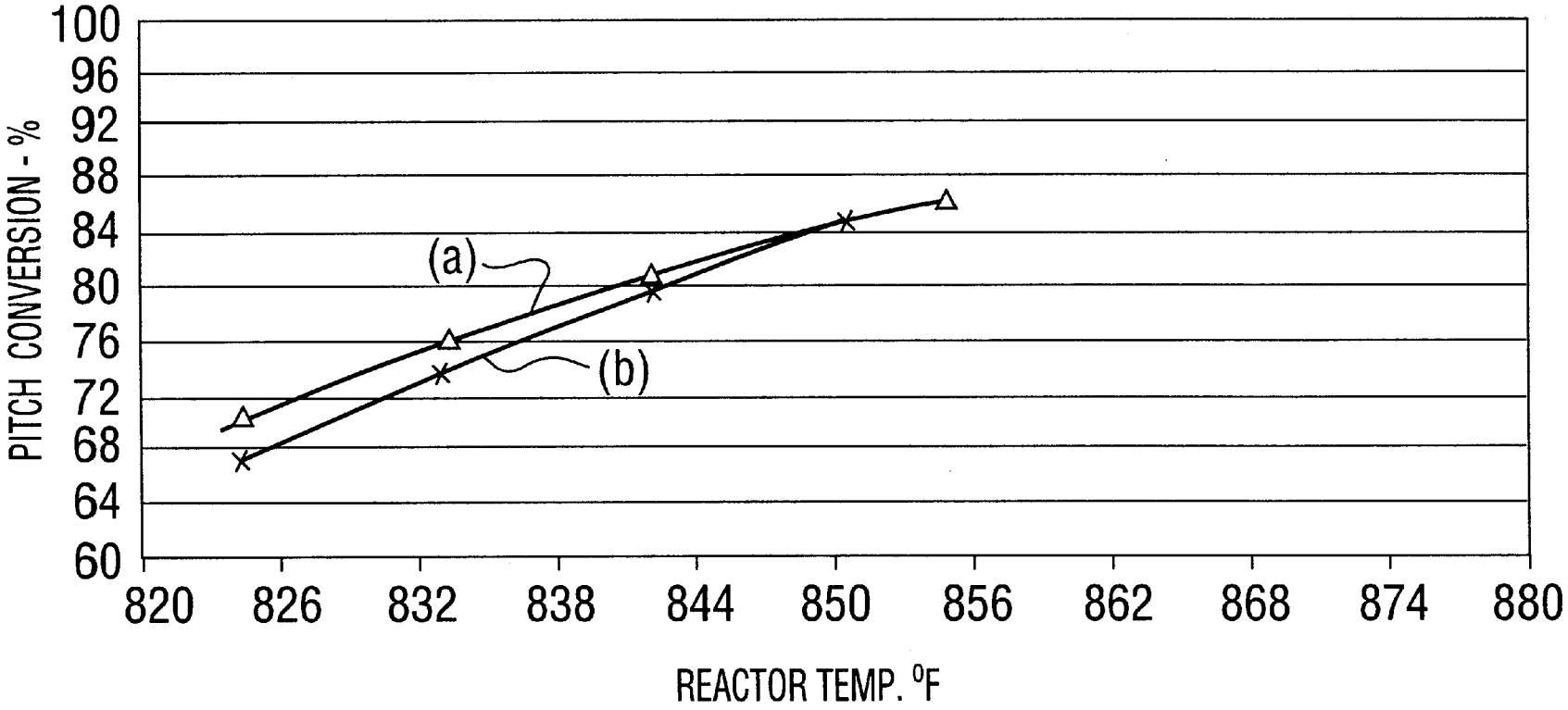
FIG. 13 is a plot of pitch conversion vs. reactor temperature for two different feeds.

The results are shown in FIG. 13 and it can be seen that the lines showing conversion rates converge to substantially meet by a reaction temperature of about 844° F. It would have been expected that the two lines would have remained parallel because of the different amounts of 975° F.+material in the feeds. The only explanation for the convergence of the lines is that a portion of the heavy gas oil in the feed is also cracked at the higher reactor temperatures.

The data presented in the above examples shows that the aromatics surrounding the asphaltenes are converted at a faster rate relative to the asphaltenes. If the aromatics phase is kept in balance with the asphaltenes, and the polar strength of the polar aromatic phase is limited by dilution by less polar aromatics, then mesophase generation tendency can be controlled and the high conversion of very hard to process feedstocks can be achieved.

TABLE 1

HYDROCARBON TYPE ANALYSIS OF PETROLEUM FRACTIONS

| Sample | Method | Fractions | | | |
|---|---|---|---|---|---|
| | | Saturates | Aromatics | Polars | Asphaltenes ($C_1$) |
| Naphtha | low resolution MS | 84.73 | 15.26 | — | — |
| Distillate | low resolution MS | 54.35 | 45.65 | — | — |
| Light VGO | low resolution MS | 32.37 | 67.63 | — | — |
| Aromatic oil | low resolution MS | 14.72 | 81.60 | — | — |
| | chromatography | 15.54 | 80.81 | 3.65 | — |
| VGO | low resolution MS | 18.74 | 77.74 | — | — |
| | chromatography | 20.52 | 75.98 | 3.50 | — |
| Feed* | low resolution MS | 22.69 | 52.95 | — | — |
| (VVR) | chromatography | 23.28 | 51.40 | 25.32 | 16.57 |
| Pitch* | low resolution MS | 14.20 | 62.78 | — | — |
| | chromatography | 14.23 | 64.48 | 21.29 | 29.49 |
| Reactor* | low resolution MS | 14.89 | 71.35 | — | — |
| Middle (R/A) | chromatography | 15.24 | 70.04 | 14.72 | 24.96 |

*Results based on deasphalted sample

TABLE 2

| | % By Weight | | | | |
|---|---|---|---|---|---|
| | Mono-Aromatics | di-Aromatics | tri-Aromatics | tetra-Aromatics | Penta+ |
| Naphtha | 15 | — | — | — | — |
| Distillate | 27 | 16 | — | — | — |
| Lt. VGO | 20 | 37 | 5 | — | — |
| VGO | 4 | 22 | 25 | 10 | — |

TABLE 2-continued

| | % By Weight | | | | |
|---|---|---|---|---|---|
| | Mono-Aromatics | di-Aromatics | tri-Aromatics | tetra-Aromatics | Penta+ |
| Aromatic oil | 2 | 23 | 30 | 9 | — |
| Feed VVR | 9 | 8 | 7 | 3 | 12* |
| Pitch | 2 | 8 | 5 | 6 | 12* |

*Has been deasphalted.

TABLE 3

ELEMENTAL ANALYSIS OF PETROLEUM FRACTIONS

| | | Elemental (wt %) | | |
|---|---|---|---|---|
| Fraction | Sample | Carbon | Hydrogen | Nitrogen |
| Polars | Feed VVR | 85.0 | 8.2 | 1.1 |
| | Reactor Middle | 87.0 | 6.5 | 2.0 |
| | Pitch | 86.8 | 6.5 | 1.8 |
| Aromatics | Feed VVR | 86.4 | 9.5 | 0.3 |
| | Reactor Middle | 89.6 | 6.8 | 0.3 |
| | Pitch | 89.3 | 6.8 | 0.2 |
| Saturates | Feed VVR | 86.0 | 13.8 | 0.0 |
| | Reactor Middle | 86.0 | 14.0 | 0.0 |
| | Pitch | 86.0 | 13.8 | 0.0 |

TABLE 4

AROMATIC CARBON NMR ANALYSIS OF PETROLEUM FRACTIONS

| | | Quaternary Carbons (mole %) | | | Protonated Carbons (mole %) | | | |
|---|---|---|---|---|---|---|---|---|
| Fraction | Sample | substituted (Q1) | poly (Q2) | total | mono (Hb) | poly (Ha) | total | Aromaticity (f) |
| Polars | Feed VVR | 10.0 | 12.3 | 22.3 | 7.8 | 15.7 | 23.5 | 0.46 |
| | Reactor Middle | 10.7 | 19.6 | 30.3 | 8.5 | 31.9 | 40.4 | 0.71 |
| | Pitch | 9.7 | 23.3 | 33.0 | 8.1 | 31.6 | 39.8 | 0.73 |
| Aromatics | Feed VVR | 9.2 | 11.9 | 21.1 | 7.6 | 11.2 | 18.8 | 0.40 |
| | Reactor Middle | 12.3 | 17.9 | 29.3 | 10.2 | 35.1 | 45.3 | 0.75 |
| | Pitch | 12.7 | 15.5 | 28.2 | 8.7 | 31.8 | 40.5 | 0.67 |
| Saturates | Feed VVR | 0.6 | 1.8 | 2.3 | 1.9 | 0.6 | 2.5 | 0.05 |
| | Reactor Middle | 0.4 | 1.0 | 1.4 | 1.3 | 0.5 | 1.7 | 0.03 |
| | Pitch | 0.5 | 2.3 | 2.8 | 1.1 | 0.4 | 1.5 | 0.04 |

Example of carbon types in a hypothetical molecule

It is claimed:

1. A process for hydrocracking a heavy hydrocarbon oil feedstock, a substantial portion of which boils above 524° C. which comprises:

(a) preparing a slurry feed of a mixture of heavy hydrocarbon oil feedstock and from about 0.01–4.0% by weight (based on fresh feedstock) of coke-inhibiting additive particles selected from the group consisting of coal, non-coal, fly ash, pyrite and iron compounds which are not active hydrogenation catalysts, passing said slurry feed upwardly through a confined vertical hydrocracking zone in the presence of hydrogen and in the absence of an active hydrogenation catalyst, said hydrocracking zone being maintained at a temperature above about 450° C., a pressure of at least 3.5 MPa and a space velocity of up to 4 volumes of hydrocarbon oil per hour per volume of hydrocracking zone capacity, (b) removing from the top of said hydrocracking zone a mixed effluent containing a gaseous phase comprising hydrogen and vaporous hydrocarbons and a liquid phase comprising heavy hydrocarbons, (c) passing said mixed effluent into a hot separator vessel, (d) withdrawing from the top of the separator a gaseous stream comprising hydrogen and vaporous hydrocarbons, (e) withdrawing from the bottom of the separator a liquid stream comprising liquid hydrocarbons and particles of the coke-inhibiting additive, (f) fractionating the separated liquid stream to obtain a pitch bottom stream which boils above 495° C., said pitch stream containing said additive particles, and an aromatic heavy gas oil fraction boiling in the range of 360 to 524° C., (g) recycling at least part of said pitch stream containing additive particles to form about 5 to 15% by weight of the feedstock to the hydrocracking zone, and (h) recycling at least part of said aromatic heavy gas oil fraction to form about 15 to 50% by weight of the feedstock to the hydrocracking zone.

2. Process according to claim 1 wherein the hydrocracking zone is maintained at a temperature above about 470° C.

3. Process according to claim 2 wherein the aromatic heavy gas oil has a boiling point above about 400° C.

4. Process according to claim 1 wherein the heavy hydrocarbon oil feedstock is a visbroken vacuum residue.

5. Process according to claim 1 wherein the heavy hydrocarbon oil feedstock is an asphaltene rich product from a deasphalting process.

6. Process according to claim 1 wherein the heavy hydrocarbon oil feedstock is processed prior to hydrocracking to remove high boiling paraffinic material.

7. Process according to claim 1 wherein part of the fractionated heavy hydrocarbon stream boiling above 450° C. comprises a pitch product of the process and this pitch is fed to a thermal cracking process.

8. Process according to claim 1 wherein the aromatic heavy gas oil contains about 100 to 110% of the feed nitrogen concentration.

9. Process according to claim 1 wherein the coke-inhibiting additive particles have sizes of less than about 45 $\mu$m.

* * * * *